United States Patent [19]

Sweet, Jr.

[11] Patent Number: 4,834,126

[45] Date of Patent: May 30, 1989

[54] FIBER GLASS UMBRELLA CONSTRUCTION

[76] Inventor: Raymond G. Sweet, Jr., 3501 Acapulco Dr., Miramar, Fla. 33023

[21] Appl. No.: 131,929

[22] Filed: Dec. 11, 1987

[51] Int. Cl.[4] ..... A45B 19/00

[52] U.S. Cl. ..... 135/25 R; 135/20 R

[58] Field of Search ..... 135/25 R, 20 R, 34, 135/25 A, 28, 31

[56] References Cited

U.S. PATENT DOCUMENTS

| | | | |
|---|---|---|---|
| 3,424,180 | 1/1969 | Andolfi | 135/28 |
| 3,844,301 | 10/1974 | Harrell | 135/20 R |
| 4,061,154 | 12/1977 | Cox et al. | 135/34 |
| 4,131,954 | 1/1979 | Brock et al. | 135/20 R |
| 4,368,749 | 1/1983 | Lindler et al. | 135/20 R |
| 4,624,275 | 11/1986 | Baldwin | 135/25 R |

*Primary Examiner*—David A. Scherbel

*Assistant Examiner*—Caroline D. Dennison

*Attorney, Agent, or Firm*—Roberts, Spiecens & Cohen

[57] ABSTRACT

An umbrella construction is provided which consists of a central rod and a canopy adapted to be supported thereupon. A plurality of ribs are pivotally connected to the support and a plurality of struts are pivotally connected between the central rod and the respective ribs. Nylon fixtures are employed for pivotally receiving the proximal ends of the struts and ribs with respect to the central rod. A further Nylon fixture is provided for pivotally connecting each strut to its associated rib. The ribs are provided with fixtures at the opposite extremities thereof for purposes of engaging the canopy and for purposes of pivotally engaging the Nylon fixture on the central rod. The ribs and struts are fabricated from fiber glass consisting of strands of fiber glass embedded in a polyester resin matrix.

11 Claims, 3 Drawing Sheets

FIBER GLASS UMBRELLA CONSTRUCTION

FIELD OF INVENTION

This invention relates to collapsible umbrella constructions and more particularly to collapsible umbrella constructions involving canopies supported on ribs controlled by associated struts.

BACKGROUND

Collapsible umbrella structures are utilized for numerous purposes. One type of collapsible umbrella construction is that employed in connection with the fabrication of beach umbrellas. These umbrellas must withstand the corrosive effects of salt water and at the same time must be sufficiently strong to permit repeated and extended usage while resisting the effects of wind and harsh treatment. Another type of umbrella construction is that constituting a personal umbrella intended to be collapsed between an extended or stretched configuration and a collapsed or bundled configuration wherein the canopy and its supporting ribs come to rest surrounding and bundled around a supporting central rod or pole.

A number of umbrella constructions have been patented such as, for example, in U.S. Pat. Nos. 3,424,180; 3,844,301; 3,890,990; and 4,370,994.

In U.S. Pat. No. 3,424,180, G. Andolfi reveals a construction for an umbrella, beach sun shade or parasol which is completely made of a plastic material such as resin and fiber glass. The framework is alleged to be of very easy and ready assembly without the use of any metal parts thus resulting in a rust-proof structure. The composition is, moreover, stated to be considerably less weight than corresponding metal frameworks.

V. Harrell in U.S. Pat. No. 3,844,301 reveals a collapsible umbrella having a plastic frame consisting of dual U-shaped constructions. The frame includes an integral handle in which a control member is manually reciprocated for opening the associated canopy and retracting the same into the frame. It is disclosed that the frame includes a closure at both ends for protecting the folded canopy. The canopy is supported by a plurality of flexible ribs which are used to support the canopy in the configuration of a transparent plastic bubble. The ribs are molded from a flexible plastic material such a vinyl-chloride compound with controlled filler to obtain a desired flexibility.

U.S. Pat. No. 3,890,990 (J. Schafer) reveals a fastening arrangement for attaching a crown, a handle, and dome rib parts to a stick and dome rib respectively. The fastening arrangement includes an enlarged recess in a member to be attached to the stick or dome rib and a retaining member forced into the recess and locked in the recess so as to bite into the wall of the recess and into the surface of the stick or dome rib.

B. Pittman shows in U.S. Pat. No. 4,370,994 an inflatable umbrella provided in such a way as to be collapsible and so as to be retained in the form of a small, easily carried package when not in use. The construction can be rapidly inflated to an operative configuration by the user or by an air source. The umbrella comprises a flexible plastic cover sheet having a generally circular outline and undercarriage which includes a flexible plastic panel having a star-like configuration and elongate flexible plastic tubular member having a bulbous handle portion at the free end, and a valve arrangement mounted on the handle to permit air to be selectively blown into and released from the interior of the tubular member and enclosed air space. The star-like outline of the panel defines radiating spokes of the air space which extend to a point closely adjacent to the periphery of the cover sheet.

While the above constructions are generally satisfactory for the purposes intended, they are not suited generally for withstanding the abuse and hard handling to which such umbrella structures are usually subjected, nor are they susceptible to providing extended longevity and thus they do not anticipate the purpose of the present invention.

SUMMARY OF THE INVENTION

It is an object of the invention to provide a improved generally non-metallic umbrella construction which is susceptible of resisting abusive handling and forces which are capable of destroying plastic umbrellas of a structure of a type which is heretofore known.

It is another object of the invention to provide an improved umbrella, the structural parts of which are made of fiber glass rods of unique and advantageous characteristics and the connecting elements of which are made of a suitably cooperating plastic such as Nylon.

It is yet another object of the invention to provide an improved umbrella construction which is of relatively light weight and which is extremely durable and which includes moving parts which allow for a smoother opening and closing of the frame than that known heretofore and which permits a non-binding opening and closing of the frame.

It is yet another object of the invention to provide an improved plastic umbrella construction designed to replace metallic frameworks heretofore employed and capable of being employed in such a manner as to enable the metallic frameworks to be readily removed and replaced.

To achieve the above and other objects of the invention there is provided an improved umbrella construction comprising a central rod constituting a support, a canopy adapted to be supported by said support, a plurality of ribs pivotally connected to said support and adapted to support said canopy selectively in arrangement slidable on the central rod with a plurality of struts being pivotally connected to the control arrangement and to respective of the ribs whereby the ribs can be bundled against the rod and stretched or extended radially outwards from the same in order to stretch the canopy. The ribs and the struts each include fiber glass and a plastic matrix in which the fiber glass is embedded.

In accordance with a preferred version of the invention the plastic matrices are of a resin, preferably polyester resin, and even more specifically of an isophthalic polyester resin. The ribs are in accordance with an important feature of the invention in the order of 55–60% of fiber glass and a balance of the aforesaid matrix. The ribs and struts are of a diameter in the order of magnitude of 0.250–0.300 inches. The fiber glass embedded in the matrix is required in accordance with the invention to have characteristics or certain values in order to resist the torsional and other forces to which the umbrellas are subjected when in use. These characteristics include the following generally limitative characteristics: A flexural modulus of 1,640,000 p.s.i., tensile strength of 13,200 p.s.i., an Izod notch strength of 8.5–11.1 foot pounds; and a Barcol hardness of 26. It has been found that with these characteristics the result is obtained that the umbrella construction of the invention will have a suitably extended longevity as well as a strength capable of resisting the elevated torsional stresses to which the framework may be subjected by the winds developed by approaching storms and the like as well as the stresses induced by the natural winds occurring in the vicinity of beaches and the like.

In further accordance with the invention the ribs have proximal and distal ends relative to the central rod and the construction further comprises an annular member encircling and fixed to the central rod and defining radial slots in which to accommodate pivotally the proximal ends of the ribs. The struts preferably have first and second opposite extremities comprising at their ends fixtures defining eyelets for engaging the control means or arrangement mentioned above and for engaging the ribs.

The control arrangement is preferably provided with radial slots to receive the fixtures and eyelets on the first extremities of the struts and is further provided with an annular groove interconnecting the slots. A wire loop or the like is employed in the groove to pass through the eyelets thereby fastening the struts pivotally to the control arrangement which is slidable on the central rod.

In further accordance with the invention further fixtures are generally centrally located on the ribs and provided with openings with which the eyelets of the fixtures on the second extremities of the struts are aligned. A pivot arrangement such as a rivet passes through each of the openings and the corresponding eyelets to constitute a pivotal connection.

The above mentioned annular member is generally of a structure similar to that of the control member and is provided with radial slots and an interconnecting annular groove. The construction further employs fixtures on the proximal ends of the ribs to engage in the radial slots and a wire loop is provided in the related annular groove to engage the last referred to fixtures.

As will be noted in the description which follows hereinafter the fixtures, annular member and control arrangement are of plastic, preferably of Nylon. Tip members are provided on the distal ends of the ribs to engage the canopy and these tip members are also preferably of Nylon or the like.

As a further significant feature of the invention, the fiber glass is preferably in the order of 50 or 113 yield fiber glass. The 113 yield fiber glass is the normal reinforcing structure provided within the matrix but the 50 yield fiber glass is used to obtain increments as may be found preferable to provide the characteristics which have been referred to hereinabove.

Also essential to the characteristic features of the invention is the formation of the ribs and struts by the pultrusion process whereby the cylindrical elements forming the ribs and struts are pulled through a hot die.

The above and other objects, features and advantages of the invention will be found in the detailed description which follows hereinafter as illustrated in the accompanying drawing.

DETAILED DESCRIPTION

Figure 1:
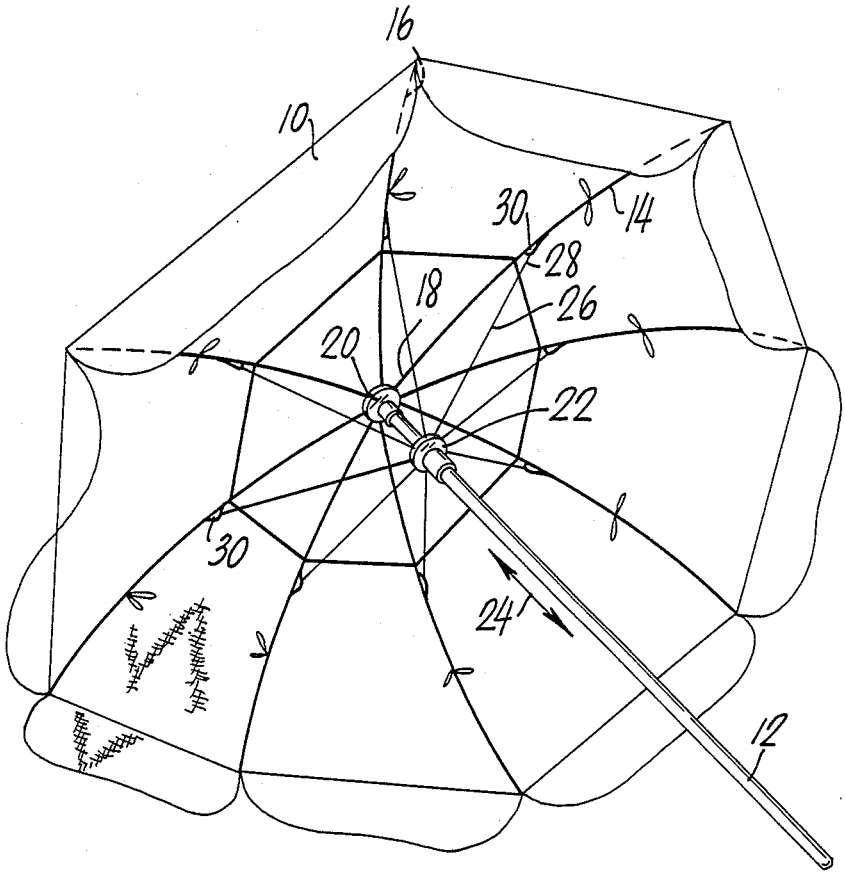
FIG. 1 is a perspective view from below of an open umbrella provided in accordance with the invention.
Figure 2:
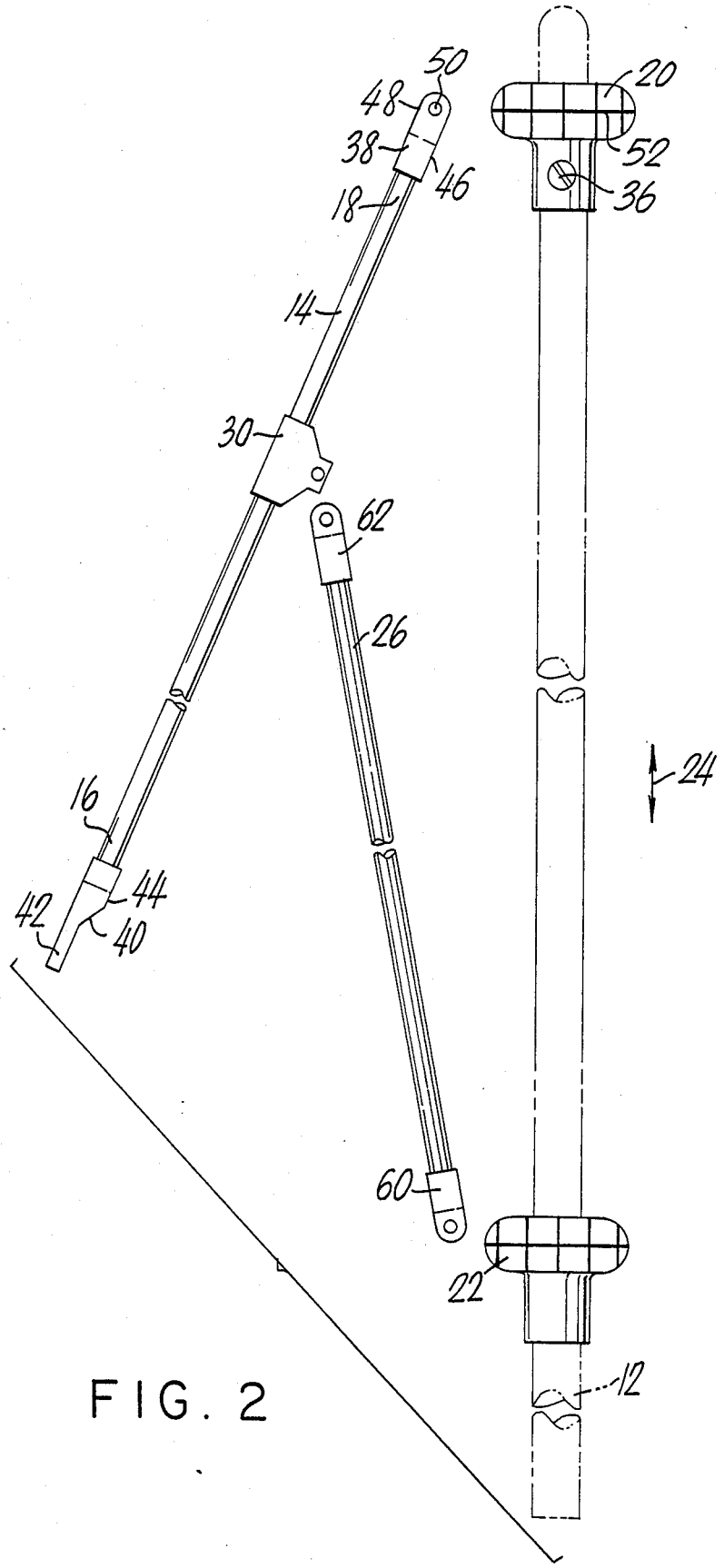
FIG. 2 is partial and exploded view of the frame of the umbrella of FIG. 1.

In the structure of FIGS. 1 and 2 is illustrated a canopy 10 supported by a central pole or rod 12. This structure is generally well known and serves the purpose of providing a beach sun shade, a personal umbrella, or a parasol or the like. It consists of a plurality of ribs 14 which in relaxed condition may be generally rectilinear in conformation but which in opened condition generally assumes a gently arched conformation so as to hold the canopy 10 in a stretched or taut condition. The illustrated form is the open condition of the umbrella in which the canopy 10 is stretched taut.

The ribs 14 have outer or distal extremities generally in the vicinity indicated at 16 and inner or proximal extremities indicated generally at 18. The inner or proximal extremities 18 are pivotally accommodated in a part 20. Also included is a slidable member 22 which is annular or torroidal in shape and generally has the same configuration as does member 20 or is generally similar thereto. The member 22 moves up and down longitudinally along the rod 12 as indicated by arrow 24 and is locked in lower-most extreme position or upper-most extreme position by spring-loaded locking members protruding from the rod 12 and not illustrated in the drawing.

A plurality of struts 26 are provided. These struts have proximal extremities relative to rod 12 which are pivotally accommodated in the member 22 and have distal extremities indicated at 28 which are accommodated in fixtures 30 which are mounted on the respective ribs.

As will be described in greater detail hereinbelow, the ribs 14 and struts 26 are fabricated of a fiber glass involving fiber glass strands embedded in a polyester resin and fabricated in a particular manner in order to provide the torsional and flexural strength which is determined in accordance with the invention to be essential to resist the abusive handling stresses and natural stresses resulting from inclement weather conditions to which such frameworks will generally be exposed.

More particularly, the fiber glass imbedded in a matrix to provide the ribs and struts of the invention will have the following required characteristics with values in the following order of magnitude:

Flexural modulus: 1,640,000 p.s.i.

Tensile Strength: 13,200 p.s.i.

Izod notch strength: 8.5–11.1 ft.lbs.

Barcol hardness: 26

To form the ribs and struts of the invention, these will be formed by a pultrusion process whereby they are pulled through a hot die. The result, it has been found, will be ribs and struts which have the required strengths to give the results which are desired to be achieved in accordance with the invention.

The central rod 12 of the umbrella of the invention may be fabricated of wood. As an alternative, this rod can also be fabricated of fiber glass with an appropriate matrix. In general, the rod and canopy may be the rod and canopy of an umbrella construction having a metallic framework fabricated of, for example, iron, steel and/or aluminum or the like. From the structure of FIG. 2 it will be apparent how the umbrella with a metallic framework may be readily processed in accordance with use of the parts of the invention to be converted to a corrosion-resisting product with the required strength.

More particularly in FIG. 2 is illustrated the annular member 22 movable longitudinally or axially along the rod or pole 12 in the direction indicated by arrow 24. Also indicated is the member 20. The members 20 and 22 are fabricated of a plastic such as nylon as has been indicated hereinabove and as will be described below or furthermore provided with matching arrangements of radially aligned slots wherein the distal ends of the ribs and struts are respectively accommodated. The member 20 is fixed in position such as by the utilization of a stainless steel screw indicated at 36. Other fastening members are also readily employed in accordance with the invention.

Mounted on the representative rib 14 are two fixtures indicated at 38 and 40. The member indicated at 40 may be provided with an eyelet in flattened extremity 42. The balance is a cylindrical pocket forming wall indicated at 44 and intended to be mounted as a cap over the distal extremity 16 of the rib 14. The proximal end 18 of the rib 14 is also provided such that fixture 38 has a cap 46 mounted thereupon, there being a flat portion 48 with an eyelet 50 which is aligned with an annular groove 52 transecting the radial slots in the member 20. Through this annular groove and through the eyelets 50 is extended a galvanized 18 gauge wire 51 which is resistant to corrosion and which holds all of the ribs in position in their respectively accommodating slots so that a readily removable pivot is provided relative to the respective ribs.

Figure 4:
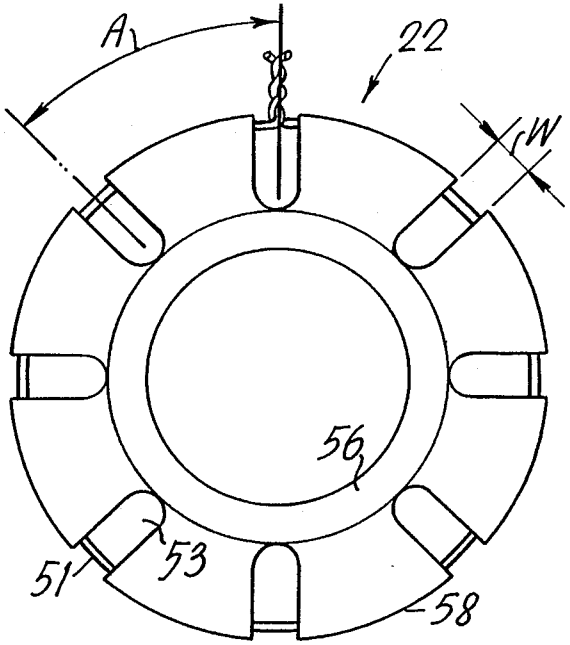
FIG. 4 is a top view of the construction of FIG. 3.
Figure 3:
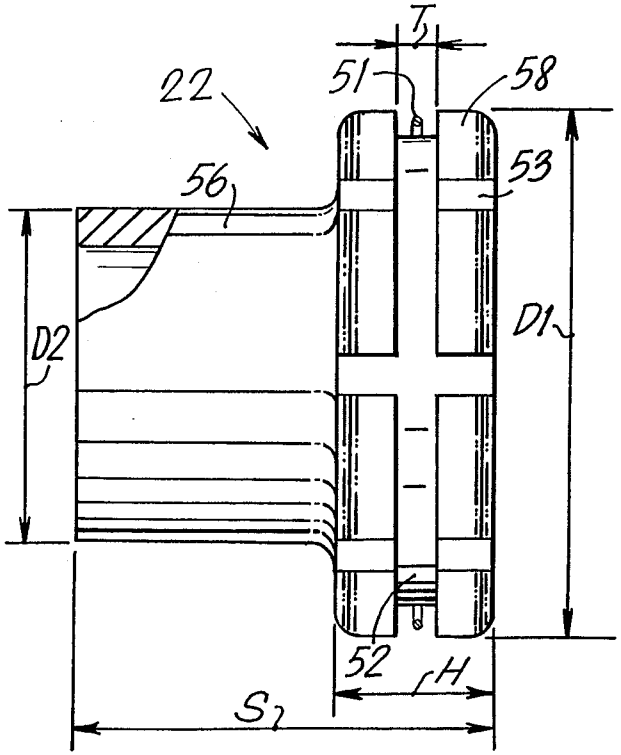
FIG. 3 is a side view of a torroidal or annular member adapted for constituting a rib support on the central pole or rod of the umbrella construction of FIGS. 1 and 2.

FIGS. 3 and 4 respectively show side and end views of the fixed and slidable members 20 and 22. Therein will be seen the annular groove 52 and the accommodating radial slots 53 which receive the capped and eyeletted ends or fixtures mounted on the proximal ends of the associated ribs. The height of the portion provided with the slots is generally indicated at H. It is in the range of 0.800 inches. The slots are indicated as being radially disposed. The widths of these slots are generally indicated at W which will preferably be in the order of 0.240–0.25 inches or the like. The angle A between the center lines or radii of the respective slots will preferably be in the order of 45° thus providing accommodations for sufficient ribs to stretch the canopy taut.

The fixtures are of mushroom configuration, having base sections 56 and the annular grooves in the head portion 58 will have a thickness T in the order of magnitude of 0.092 inches. The total height of these elements indicated at S will be in the order of magnitude of 2.430 inches. The overall diameter of the upper portion or head 58 is indicated at D1 and this is in the order of magnitude of 3.100 inches. The diameter of the stem 56 is shown at D2, this diameter being in the order of magnitude of 1.850 inches.

Figure 5:
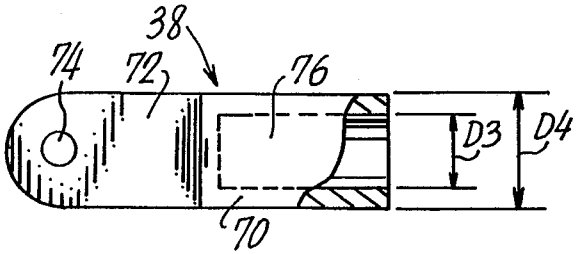
FIG. 5 is a side view of a fixture adapted for use at extremities of the struts and ribs of the umbrella construction of FIGS. 1 and 2.

FIG. 5 illustrates the configuration of cap members 38 (see FIG. 2) as well as cap members or fixtures 60 and 62 which are fit to the proximal and distal extremities of the respective struts 26. The fixtures each include a cap section 70 having a flattened portion 72 extending therefrom. The flat portion 72 is provided with an eyelet or opening 74 with respect to which pivotal coupling or connection may be made. The cap section 70 is provided with a central blind bore 76 which fits over the respective end of the element to which the fixture is to be attached. These fixtures are preferably cemented in position by the use of an appropriate cement or glue.

Figure 6:
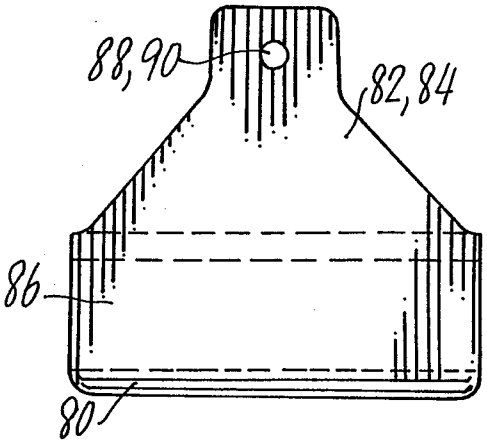
FIG. 6 is a side view of a further fixture mounted on the respective ribs of the framework of FIG. 2.

In FIG. 6 the diameter of bore 76 is indicated at D3 which is of a magnitude sufficient to accommodate the protrusion into the same of a strut or rod preferably having a diameter in the order of magnitude of 0.250 inches. The overall diameter of the illustrated fixture is indicated at D4 which is generally in the order of magnitude of 0.500 inches.

Figure 7:
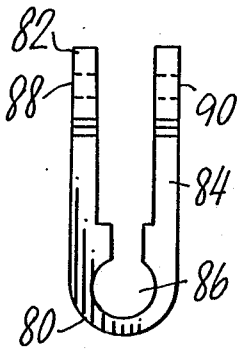
FIG. 7 is an end view of the fixture of FIG. 6.

As mentioned hereinabove, the struts are pivotally connected to associated of the aforementioned ribs. One such fixture 30 is indicated in FIG. 1 as well as in FIG. 2. The details of this fixture are seen in FIGS. 6 and 7 wherein the fixture is seen as comprising a cylindrical portion 80 and two legs 82 and 84 constituting with the cylindrical section. Portion 80 a U-shaped cross-section 80 has a bore running therethrough as indicated at 86 which is preferably provided with a ribbed inner surface for grasping onto the associated rib to which the fixture is attached by cementing or gluing. The side elements 82 and 84 are provided with corresponding bores 88 and 90 enabling a pivotal connection to be made by means of a rivet, bolt or the like with the corresponding fixture on the associated end of the respective strut which is to be pivotally connected thereto.

The various fixtures which are illustrated in FIGS. 3, 4, 5, 6, and 7 are formed of Nylon or a like plastic which is susceptible of being cemented or glued to the fiber glass matrix mentioned hereinabove but which is otherwise capable of being of a self-lubricating nature so that pivoting is readily affected without binding. The only metallic structure employed in the foregoing is in the wire passing around the annular grooves which are provided in members 20 and 22 for purposes of making pivotal connection with the associated extremities of the ribs and struts. It should be noted, however, that the wires may be substituted for by appropriate plastic elements having adequate flexibility to enable a threading through the various grooves and eyelets. However, the fact that these wires ar galvanized make the same resistant to corrosion and provide appropriate strength for retaining the framework together as a unitary but articulated framework.

As has been indicated above, the fiber glass structures employed in accordance with the invention have specific characteristics and are formed in a specific way, namely by pultrusion. This affords the necessary strength and resistance to various and arbitrary stresses as may be required to provide a superior umbrella construction.

It is to be noted that the fiber glass rods of the invention are preferably formed of 55–60% fiber glass strands or rovings which have been formed into a matrix and fabricated into a rod formed by pulling the rod through a hot die in the pultrusion process. The glass in accordance with the invention to give the necessary results is a 50 or 113 yield glass strand with a 250 yield being at the general limit of the spectrum of useful glasses.

Owens-Corning Fiberglas (Polyester Division of Charlotte, N.C.) provides a number of polyresins which are capable of being utilized in accordance with the provisions of the invention. One specific polyester resin which is particularly advantageous in accordance with the present invention is that polyresin known as E-606. This is a medium reactivity resilient isopthalic polyester resin which has the following properties:

Uncured Resin Properties

Viscosity #4 spindle (60 rpm, 77° F. cps): 3300
Weight per gallon (lbs.): 9.5
Acid value: 12
Monomer content (%): 30
Water content (%): 0.07

Curing Properties

SPI Exotherm test, 1% BPO
150°–190° F.(mins.): 6.2
150°–peak (mins.): 7.4
peak (°F.): 430

Cured Neat Resin Properties

Flexural Strength (psi)
Dry: 19,000
2 hr. boil: 14,500
24 hr. boil, 10,900
Flexural Modulus (psi)
Dry: 480,000
2 hr. boil: 440,000
24 hr. boil: 310,000
Tensile strength (psi): 10,500
Tensile modulus (psi): 440,000
Tensile elongation (%): 4.0
DTUL (°F. @264 psi): 174
Barcol hardness: 34

The molding compound formulation and the physical properties are as next indicated hereinafter:

Sheet Molding Compound Formulation

E-606 polyester resin: 23.98%
Styrene: 8.74%
Microthene FN-510: 5.58%
Zinc Stearate: 0.74%
TBPB: 0.37%
Camelwite: 37.17%
GHA-331: 18.58%
Pigment paste: 3.72%
MgO as a dispersion: 0.37%

Glass Content, 29% 951 Fiberglas roving

Molding Conditions: 300° F. for 3 minutes
Thickness-110 Mils

Physical Properties (typical)

Flexural Strength (psi): 25,500
Flexural Modulus (psi): 1,640,000
Tensile Strength (psi): 13,200
Tensile Modulus (psi): 2,040,000
Barcol Hardness: 26
Water absorption (%): 0.06
Izod impact, notched (ft.-lbs.)
room temperature: 8.5
−20° F.: 11.1
Izod impact, unnotched (ft.-lbs.)
room temperature: 14.4
−20° F.: 17.3

As has been mentioned hereinabove, the rods employed in the invention are preferably formed with the pultrusion process.

Early work in this area is shown in U.S. Pat. No. 3,470,051 on a method for pultruding emulsified thermoplastics such as polystyrene, PVC, and acrylic which is applicable to polyester resins. Involved is a system of delivering molten polymer, achieving wetout with the fiber reinforcement, and pulling the material rapidly through a cold die. Using modified horizontal equipment, speeds in the 15 to 20 ft./min. range (contrasted to 1 to 7 ft./min. for thermosets) may be possible.

The invention is particularly served by the utilization of Owens-Corning Fiberglas 424 pultrusion roving. Owens-Corning Fiberglas (Polyester Division of Charlotte, N.C.) has developed a new family of reinforcements that is produced from the latest glass forming technology. Type 30 reinforcement is produced by pulling individual fibers directly from a bushing and winding them on a shippable package.

Owens-Corning Fiberglas has a 424 pultrusion roving which is used in a broad range of shapes and configurations. The formulation sizing system is applied to the filaments near the bushing to insure a uniform distribution of binder on the glass as it enters the resin matrix. This roving is primarily oriented toward polyester resin pultrusion systems.

The key variables in making 424 roving produce optimum results in the pultrusion process are the tensioning devices, resin/filler selection, die shape and temperature, and finally post finishing steps.

Tensioning Devices - the roving doffs should be run from an upright position with a guide eye located 3–6 inches above the center of the package. All contact points such as those in an eyeboard should be ceramic materials or large enough guide eyes to avoid friction. Minimum tension should be applied to the strands until they have entered the resin bath.

The strands should be separated as much as possible while going into the bath. A pin bar and breaker bars should be ½" to 1" diameter stainless steel with an adjustable breaker bar to add or reduce tension. The last contact point should align the bundle with a stripper die.

Resin/Filler Selection - approximately 10–15% filler should be added to the resin to improve rod appearance. Overall resin viscosity should be under 2000 centipoise. Catalyst level should not exceed 1% and most systems are pre-promoted with a BPO system.

Die Shape and Temperature - a stepped diameter die is used to improve surface quality. Depending on part diameter, optimum temperature is approximately 260° with reduced temperature as exotherm builds up in the latter portion of the line.

In the foregoing construction, the fixtures, annular members and control are preferably of Nylon, specifically Nylon 66. Its characteristics are as follows:

Flexural modulus: Nylon 66 420 p.s.i.
Young's modulus of elasticity: Nylon 66 R.120 p.s.i.
Izod notch strength: Nylon 66 0.8–1.0 ft.lbs.
Flexural strength: Nylon 66 17,000

There will now be obvious to those skilled in the art many modifications and variations of the structure and the arrangement set forth hereinabove. The structure and arrangements will not depart from the scope of the invention if defined by the following claims.

What is claimed is:

1. An umbrella construction comprising a central rod constituting a support, a canopy adapted to be supported by said support, a plurality of ribs pivotally connected to said support and adapted to support said canopy selectively in stretched and collapsed conditions, a control means slidable on said central rod, and a plurality of struts pivotally connected to said control means and to respective of said ribs whereby the ribs can be bundled against said rod or extended radially outwards from the same to stretch said canopy, each said rib including fiber glass and a plastic matrix in which the fiber glass is embedded, said struts each including fiber glass and a plastic matrix which the fiber glass is embedded, the plastic matrices being of isophthalic polyester resin, the ribs being in the order of 55–60% of fiber glass and a balance of matrix, the ribs and struts being of a diameter in the order of magnitude of 0.250–0.300 inches, the fiber glass being 50 or 113 yield fiber glass, the fiber glass in each matrix having the following characteristics with values of the following order of magnitude:

Flexural modulus: 1,640,000 p.s.i.
Tensile strength: 13,200 p.s.i.
Izod notch strength: 8.5–11.1 ft. lbs.
Barcol hardness: 26, the ribs and struts being rods which are formed by being drawn through a hot die in a pultrusion process.

2. An umbrella construction as claimed in claim 1 wherein the ribs have proximal and distal ends relative to said central rod, and further comprising an annular member encircling and fixed to said central rod and defining radial slots within which to accommodate pivotally the proximal ends of the ribs.

3. An umbrella construction as claimed in claim 1 wherein the struts have first and second opposite extremities, comprising fixtures on the opposite extremities of the struts defining eyelets for engaging the control means and for engaging said ribs.

4. An umbrella construction as claimed in claim 3 wherein the control means is provided with radial slots to receive the fixtures and eyelets on said first extremities and is further provided with an annular groove interconnecting said slots, said umbrella construction further comprising a wire loop in said groove passing through said eyelets.

5. An umbrella construction as claimed in claim 4 comprising second fixtures generally centrally located on said ribs and provided with openings with which the eyelets of the fixtures on the second extremity of the struts are aligned and pivot means passing through said openings the latter said eyelets to constitute a pivotal connection.

6. An umbrella construction as claimed in claim 5 wherein said annular member is generally of a structure similar to that of said control means and is provided with radial slots and an interconnecting annular groove, comprising fixtures on the proximal ends of said ribs to engage in the latter said radial slots and a wire loop in the latter and said groove engaging the latter said fixtures.

7. An umbrella construction as claimed in claim 6 wherein said fixtures, annular member and control means are of Nylon.

8. An umbrella construction as claimed in claim 7 comprising tip members on the distal ends of the ribs to engage the canopy.

9. An umbrella construction as claimed in claim wherein the Nylon has characteristics of the following order of magnitude:

Flexural modulus: 420 p.s.i.
Young's modulus of electricity: 120 p.s.i.
Izod notch strength: 0.8–1.0 ft. lbs.
Flexural strength: 17,000

10. An umbrella construction as claimed in claim 9 wherein said isopthalic resin has uncured properties in the following order of magnitude:

Viscosity #4 spindle (60 rpm, 77° F. cps) 3300
Weight per gallon (lbs.): 9.5
Acid value: 12
Monomer content (%): 30
Water content (%): 0.07

11. An umbrella construction as claimed in claim 10 wherein said isophthalic resin has properties in the following order of magnitude:

Flexural Strength (psi)
Dry: 19,000
2 hr. boil: 14,500
24 hr. boil: 10,900
Flexural Modulus (psi)
Dry: 480,000
2 hr. boil: 440,000
24 hr. boil: 310,000
Tensile strength (psi): 10,500
Tensile modulus (psi): 440,000
Tensile elongation (%): 4.0
DTUL °F. @264 psi): 174
Barcol hardness: 34.

* * * * *